United States Patent [19]

Salminen et al.

[11] Patent Number: 4,496,429

[45] Date of Patent: Jan. 29, 1985

[54] EXTENDED NIP PRESS FOR A PAPER MACHINE

[75] Inventors: Kari Salminen, Ylöjärvi; Nils Söderholm, Anjala, both of Finland

[73] Assignee: Oy Tampella Ab, Tampere, Finland

[21] Appl. No.: 478,907

[22] Filed: Mar. 25, 1983

[30] Foreign Application Priority Data

Apr. 1, 1982 [FI] Finland ..... 821139

[51] Int. Cl.[3] ..... D21F 3/02; D21F 3/06

[52] U.S. Cl. ..... 162/358; 100/118; 100/153; 162/205

[58] Field of Search ..... 162/358, 205; 100/118, 100/121, 153, 156

[56] References Cited

U.S. PATENT DOCUMENTS

| | | | |
|---|---|---|---|
| 2,890,748 | 6/1959 | Heinrich | 162/358 |
| 2,987,988 | 6/1961 | Robledano | 100/118 |
| 3,758,381 | 9/1973 | Knoke | 162/358 X |
| 3,775,242 | 11/1973 | Orbison et al. | 100/118 X |
| 3,798,121 | 3/1974 | Busker et al. | 162/358 X |
| 3,814,665 | 6/1974 | Orbison et al. | 162/358 |

FOREIGN PATENT DOCUMENTS 6738 8/1917 Finland .

*Primary Examiner*—S. Leon Bashore
*Assistant Examiner*—K. M. Hastings
*Attorney, Agent, or Firm*—Ladas & Parry

[57] ABSTRACT

An extended nip press for a paper machine for removing water from a wet paper, cardboard or that kind of a fibrous or porous web. The press comprises a rotatable press roll and two band rolls parallel to the press roll and an endless press band running around them which is pressed against the press roll for forming an extended press zone. The paper web to be dried is conveyed through the pressing zone with a dewatering felt. The press band consists of several separate parallel band strips, in the pressure zone. Each band strip is equipped with its own stretching device for individual regulation of the tension of the band strip.

3 Claims, 10 Drawing Figures

Figure 1:
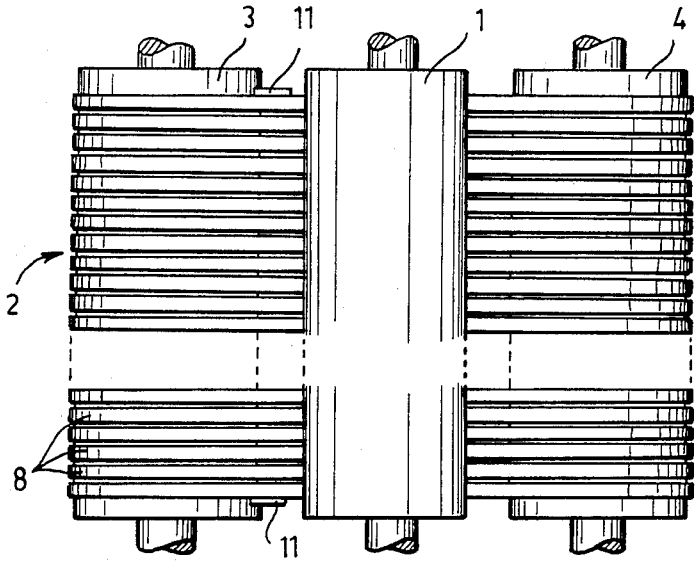

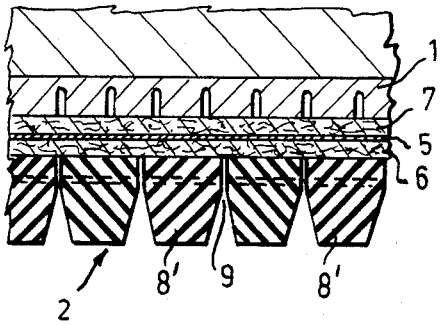
FIG. 3
FIG. 4
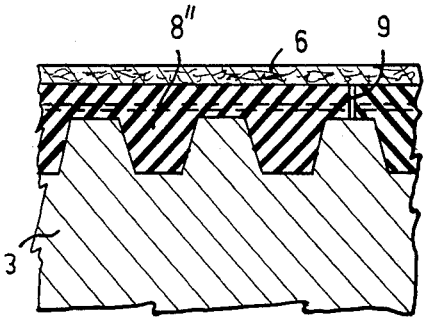
FIG. 5
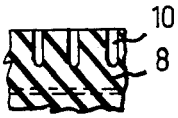
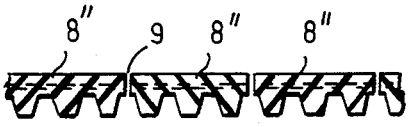
FIG. 6
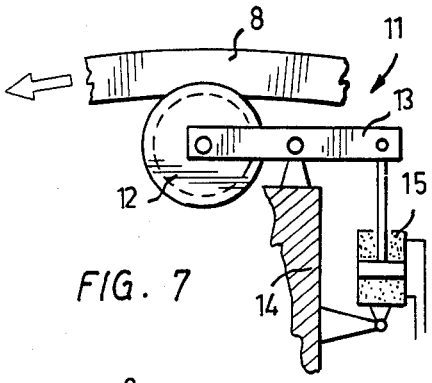
FIG. 7
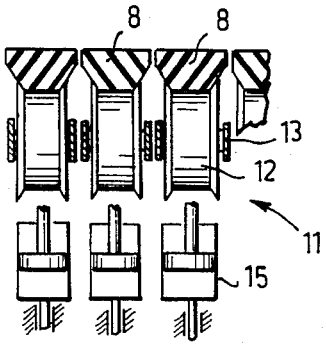
FIG. 8
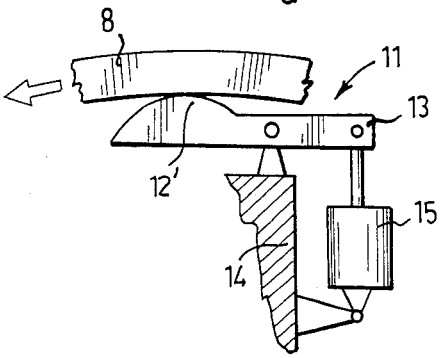
FIG. 9

EXTENDED NIP PRESS FOR A PAPER MACHINE

This invention relates to an extended nip press for a paper machine for removing water from a wet paper, cardboard or that kind of a fibrous or porous web, which press comprises a rotatable press roll, a press band, which consists of several separate, parallel, close to each other in a pressure zone running band strips, which are pressed against said press roll for forming an extended nip press zone with said press roll, at least two band rolls, over which said press band passes, at least one dewatering felt, which passes between said press roll and said press band for conveying said web to be dried trough said press zone, and stretching devices for regulating the tension of said band strips.

In a press of a paper machine it is known to extend a zone, by means of which the web to be treated is pressed against a periphery of a press roll so that the press zone extends over an essential length over the periphery of said roll. The purpose is by this way to keep the web on a longer distance under pressure when the web passes through this kind of an extended press nip so that dewatering ability of the press increases.

In U.S. Pat. No. 3,798,121 it has been suggested an extended nip press, which comprises a rotatable press roll and an endless band impermeable to water, which band is as wide as the whole press roll, which band is pressed against the part of the periphery of the press roll so that an arched pressure zone is formed between the press roll and the band. The band has to be kept tense for achieving a sufficient pressure in the pressure zone, which demands the use of a controlled deflection press roll. In addition, the band of full width can when used long enough change its shape too much, which makes it difficult to maintain the desired pressure in the pressure zone over its whole width.

FI-patent publication No. 6738 discloses a press assembly with a press band comprising several separate, parallel, close to each other in a pressure zone running band strips. The pressure force in the pressure zone can be regulated by adjusting the location of a stretch roll, around which all the band strips are arranged to pass, in proportion to another roll which is fixedly installed and which act as a second press roll. This press assembly also demands the use of a controlled deflection press roll for maintaining the desired pressure in the press zone over its entire width. Certain deformations which can occur in said band strips cannot be compensated either, if this press assembly is used.

The purpose of this invention is to provide an extended nip press, which eliminates the above-mentioned disadvantages and makes it possible to maintain and control the desired pressure in the pressure zone irrespective of the deflection of the press roll. This purpose is obtained by means of the press according to the invention, which is characterized in, that each band strip is equipped with its own stretching device for individual regulation of the tension of said band strip.

The invention is based on the idea that several narrow band strips, which, positioned close to each other, form a uniform press surface in the press zone, are used instead of a uniform press band, which is as wide as the press roll. By regulating the tension of each band strip separately the pressure can be regulated as desired—either as even or variable in a certain way—over the width of the whole press roll in spite of the deflection of said press roll. The moisture profile of the web in said extended nip press can in a simple way be regulated by stretching said band strips in different ways.

Certain deformations in said band strips can easily be compensated because the tension of each strip can be regulated separately.

Figure 2:
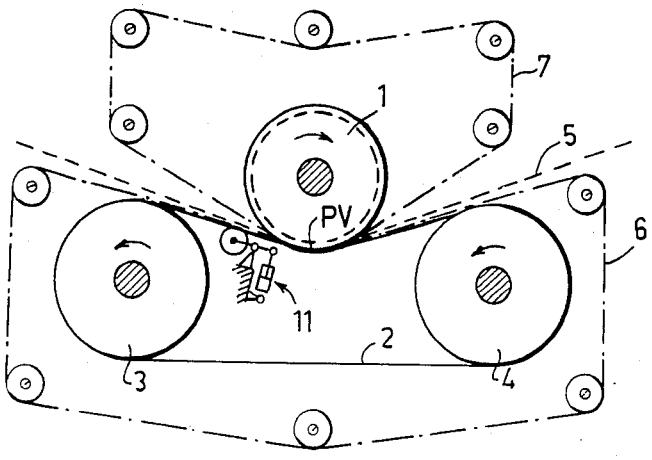
Figure 10:
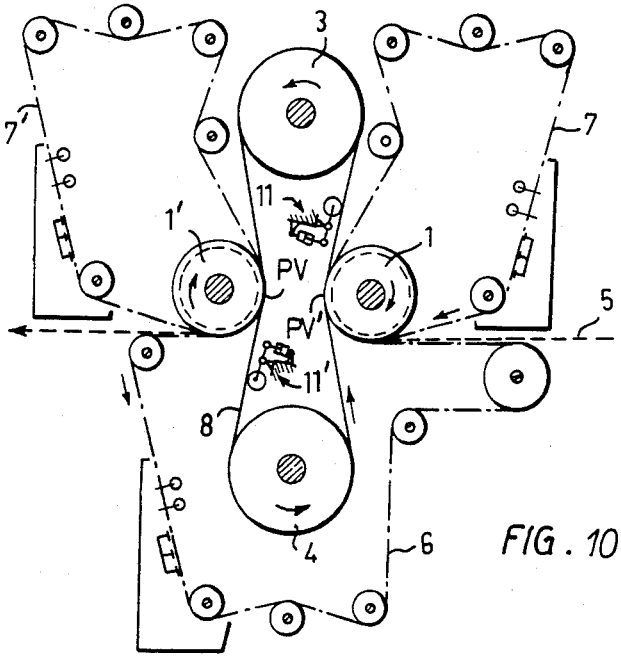

The invention is described more closely by referring to the enclosed drawings, in which FIG. 1 shows the principle of the press according to the invention seen from above, FIG. 2 is a side view of the press visualizing the first embodiment of the stretching devices, FIGS. 3 and 4 show two different embodiments of the band strips in vertical sectional view through the periphery line of the pressure zone and respectively through the periphery line of the band roll, FIG. 5 shows in sectional view a surface part of the band strip, FIG. 6 shows adjacent band strips in cross-sectional view, FIGS. 7 and 8 are side views in a greater size of the stretching devices illustrated in FIG. 2 and respectively seen into the direction of motion of the band strips, FIG. 9 is a side view of the alternative embodiment of the stretching device, FIG. 10 is a sideview of a double extended nip press according to the principle of the invention.

The extended nip press illustrated in the FIGS. 1 and 2 of the drawings comprises a rotatable press roll 1 attached on bearings onto the frame of the press and an endless press band 2, which runs around two band rolls 3, 4, parallel to the press roll and attached on bearings onto the frame of the press and which band is guided for pressing against the periphery of the press roll so that an arched, extended pressure zone PV is formed between the press surface and the press band.

The paper web 5 to be dried is guided between lower and upper drying felts 6, 7 through the press zone in order to force moisture from the wet web into the felts. In some cases only one felt may be sufficient.

The press band 2 consists of several, parallel side by side positioned narrow band strips 8, which form a uniform press surface for the web to be dried and for the drying felt.

The band strips 8 are advantageously formed by V-bands 8', FIG. 3, or V-belts 8'', FIG. 4, which are located side by side in the same level and are separated only by narrow slots 9. There can be e.g. drillings 10, FIG. 5, or holes or grooves for receiving water from the felt in the press surface of the V-bands or V-belts.

The band rolls 3, 4 have been equipped with a V-surface which corresponds to a V-profile and space of the V-bands or V-belts as illustrated in FIG. 4.

In the embodiment illustrated in FIG. 2 each band strip 8 has been equipped with a stretching device 11 of its own, which comprises a stretching roll 12, FIG. 7, which is positioned under the band strip, pressed against it and rotatably attached on bearings onto a support shaft 13, which in its turn is pivotally attached on bearings onto the frame of the press 14 like a lever arm. A pressure medium cylinder 15, which from its one end is supported onto the frame, has been connected into the free end of the support shaft. By means of the cylinder the stretching roll can be lifted and lowered, and correspondingly, the tension of the band strip can be increased and decreased.

The observation is made that the tension of each band strip can be regulated by means of the stretching devices independently of other band strips. Due to this the pressure forces caused by the band strips can be regulated in the pressure zone so that said forces are equal for the entire width of said zone regardless of the deflections in the press roll and the band rolls whereby an even pressure is achieved in the pressure zone. Alternatively, the the tension of the desired band strips can be regulated to deviate from the tension of other band strips so that across the band a varying pressure force is directed against the web to be dried, in order to accomplish the desired moisture profile for the dried web.

The embodiment of the stretching device 11 shown in FIG. 9 deviates from those shown in FIGS. 7 and 8 only in that respect that the stretching roll 12 is substituted for by a sliding shoe 12' fastly combined onto the support shaft 13.

The double extended nip press assembly shown in FIG. 10 consists in principle of a combination of two presses according to FIG. 2. The press assembly comprises two band rolls 3, 4, over which the band strips 8 are running. The band strips are pressed against two press rolls 1 and 1' positioned in opposite sides of said band and roll combination. The band forms two pressure zones PV and PV' with said band rolls. The press comprises further a lower drying felt 6 and two upper drying felts 7 and 7' for a paper web 5 to be dried. The band strips have been equipped with two stretching device groups 11 and 11'.

The drawings and the declaration attached to them have been aimed only to illustrate the idea of the invention. In details the press assembly according to the invention can be remarkably varied within the limits of the patent claims.

What we claim are:

1. An extended nip press for a paper machine for removing water from a wet paper, cardboard or that kind of a fibrous or porous web, which press comprises a rotatable press roll, a press band, which includes several separate, parallel, running band strips, said band strips being close to each other in a pressure zone, said band strips being pressed against said press roll for forming an extended nip press zone with said press roll, at least two band rolls, over which said press band passes, at least one dewatering felt, which runs between said press roll and said press band for conveying said web to be dried through said press zone, and stretching devices for regulating tension of said band strips, each band strip being equipped with its own respective stretching device for individual regulation of the tension of a respective band strip independently of each other band strip.

2. A press according to claim 1 wherein each stretching device comprises a stretching roll pressed against its respective band strip which stretching roll is loaded by a regulatable pressure medium cylinder.

3. A press according to claim 1 wherein each stretching device comprises a stretching shoe pressed against its respective band strip, which stretching shoe is loaded by a regulatable pressure medium cylinder.

* * * * *